US007587060B2

(12) United States Patent
Watanabe

(10) Patent No.: US 7,587,060 B2
(45) **Date of Patent: *Sep. 8, 2009**

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 835 days.

This patent is subject to a terminal disclaimer.

(21) Appl. No.: 11/084,117

(22) Filed: Mar. 21, 2005

(65) Prior Publication Data

US 2005/0271239 A1 Dec. 8, 2005

(30) Foreign Application Priority Data

Mar. 19, 2004 (JP) ..... 2004-080126

(51) Int. Cl.
*H04R 25/00* (2006.01)

(52) U.S. Cl. ..... 381/413; 381/407; 381/412

(58) Field of Classification Search ..... 381/407, 381/413, 412

See application file for complete search history.

(56) References Cited

U.S. PATENT DOCUMENTS

| | | | | |
|---|---|---|---|---|
| 3,767,004 | A * | 10/1973 | Liebscher | 181/172 |
| 6,088,466 | A * | 7/2000 | Proni | 381/397 |
| 6,672,423 | B2 * | 1/2004 | Kato | 181/161 |
| 7,263,198 | B2 * | 8/2007 | Onuma | 381/403 |
| 2005/0008188 | A1 * | 1/2005 | Harris | 381/404 |
| 2005/0111690 | A1 * | 5/2005 | Onuma et al. | 381/424 |

FOREIGN PATENT DOCUMENTS

| | | |
|---|---|---|
| JP | 8-51692 | 2/1996 |
| JP | 10-42392 | 2/1998 |
| JP | 2001-268690 | 9/2001 |
| JP | 2002-051394 | 2/2002 |
| JP | 2002-271893 | 9/2002 |

* cited by examiner

*Primary Examiner*—Suhan Ni
*Assistant Examiner*—Jasmine Pritchard
(74) *Attorney, Agent, or Firm*—Young & Thompson

(57) ABSTRACT

In a speaker device, each inner peripheral edge portion of a conductive damper and an ordinary damper is fixed to an area in the vicinity of a lower end of a cylindrical portion of a connecting member, and each outer peripheral edge portion of them is fixed to a support member. The conductive and ordinary dampers are attached to an area within a constant winding width of a voice coil. When the speaker device is driven, the voice coil bobbin vibrates in an axial direction of the speaker device. The voice coil bobbin sometimes rolls due to various factors. Since a fulcrum of the rolling is within the winding width, a distance r2 from the fulcrum P11 to an intersection of a central axis of the speaker device and a plane surface including a center in the winding width becomes short, and the bobbin hardly rolls.

4 Claims, 5 Drawing Sheets

SPEAKER DEVICE

TECHNICAL FIELD

The present invention relates to a structure of supporting a damper in a speaker device.

BACKGROUND ART

Conventionally, there is known an internal-magnet type speaker device including a magnetic circuit having a pot type yoke and a planar plate and a vibrating system including one or more damper, a voice coil bobbin and a voice coil.

Generally, in such the speaker device, the voice coil is wound around an area in the vicinity of a lower end of the voice coil bobbin. The area in the vicinity of the lower end of an inner peripheral wall of the voice coil bobbin is opposed to an outer peripheral wall of the plate fixed on the pot type yoke with a fixed space from each other. At the same time, the area in the vicinity of the lower end of the outer peripheral wall of the voice coil bobbin is opposed to an area in the vicinity of an upper end of a cylindrical portion of the pot type yoke with a fixed space from each other. One or more damper, which is arranged at a position above the voice coil, is fixed to the area in the vicinity of the upper end of the outer peripheral wall of the voice coil bobbin.

In such the speaker device, at the time of driving, the vibrating system such as the voice coil and the voice coil bobbin vibrates in an axial direction of the speaker device. At this time, a balance of the vibrating system is lost due to various kinds of factors, and the voice coil bobbin sometimes rolls. Rolling (to roll) means that a power affecting the voice coil bobbin becomes asymmetry due to some kind of cause and the voice coil bobbin and the like roll in the lateral direction with respect to an original vibrating direction, i.e., the axial direction of the speaker device.

Particularly, in the above-mentioned speaker device, since the damper is arranged at the position above the voice coil, a fulcrum of the rolling is located at the position above the voice coil. Therefore, a distance from the fulcrum to the area in the vicinity of the lower end of the voice coil bobbin around which the voice coil is wound becomes longer, and the lower end portion of the voice coil bobbin widely rolls (rolling) in the lateral direction with the fulcrum as its center. As a result, the voice coil contacts the pot type yoke, or the voice coil bobbin contacts the plate, and an abnormal sound problematically occurs.

There are proposed various kinds of speaker devices for decreasing the rolling phenomena. For example, there is proposed a speaker in which a mechanical filter is arranged on an upper portion of a voice coil bobbin and the mechanical filter and a diaphragm are bonded at one point on a central axi O-O (see Japanese Patent Application Laid-Open under No. 8-51692). There is also proposed a speaker for suppressing the rolling of a diaphragm and a voice coil by supporting the voice coil by a damper and a cylindrical-shape cushion (see Japanese Patent Application Laid-Open under No. 10-42392).

DISCLOSURE OF THE INVENTION

As an object to be achieved by the present invention, the above described object is cited as an example. The present invention has its object to provide a speaker device having a structure of supporting a damper capable of preventing contact of a vibrating system and a magnetic circuit system and occurrence of an abnormal sound, when the vibrating system including a voice coil bobbin rolls.

According to one aspect of the present invention, there is provided a speaker device including: a vibrating system including a damper, a voice coil bobbin, a voice coil which is wound around an outer circumference of the voice coil bobbin in a constant winding width, and a connecting member which is attached to the voice coil bobbin at a position above the voice coil, wherein an inner peripheral edge portion of the damper is attached to the connecting member within the constant winding width of the voice coil.

When the above-mentioned speaker device is driven, the voice coil bobbin vibrates in the axial direction of the speaker device. At this time, the balance of the vibrating system is sometimes lost due to various factors, and the voice coil bobbin rolls. The fulcrum of the rolling is located at the area in the vicinity of the portion supporting the connecting member by the damper. In the speaker device, since the inner peripheral edge portion of the damper is attached to the connecting member within the constant winding width of the voice coil in the non-rolling state, the fulcrum of the rolling is positioned within the constant winding width of the voice coil. Therefore, the distance from the fulcrum of the rolling to the portion around which the voice coil of the voice coil bobbin is wound becomes short, and the voice coil bobbin hardly rolls. Even when the voice coil bobbin rolls, a moving amount of the voice coil bobbin in the lateral direction becomes small. Thus, at the time of the rolling, the contact of the voice coil and the pot type yoke can be prevented, and the contact of the voice coil bobbin and the plate can be prevented, too. Thereby, the occurrence of the abnormal sound can be prevented.

In one form, the speaker device may further include a frame which supports the vibrating system, and an outer peripheral edge portion of the damper may be supported by the frame within the constant winding width of the voice coil.

In accordance with the form, since the outer peripheral edge portion of the damper is supported by the frame within the constant winding width of the voice coil, the entire portion of the damper is disposed within the constant winding width of the voice coil. At the time of the rolling, the contact of the voice coil and the pot type yoke can be prevented, and the contact of the voice coil bobbin and the plate can be prevented, too. Therefore, the occurrence of the abnormal sound can be prevented.

In a preferred example of the above-mentioned speaker device, plural dampers may be provided, and all of the plural dampers may be attached to the connecting member within the constant winding width. Even when the plural dampers are used, by attaching all the dampers to the connecting member within the winding width of the voice coil, the contact of the voice coil bobbin at the time of the rolling can be prevented.

BEST MODE FOR CARRYING OUT THE INVENTION

A preferred embodiment of the present invention will be explained hereinafter with reference to the drawings. This embodiment relates to the structure of supporting the damper in the speaker device. More concretely, a portion, i.e., the inner peripheral edge portion of the damper, is disposed within the winding width of the voice coil, and the inner peripheral edge portion of the damper is fixed to the connecting member fixed to the voice coil bobbin. Thereby, the rolling of the vibrating system including the voice coil bobbin is decreased, and the contact between the vibrating system and the magnetic circuit system including the yoke and the plate is prevented. The occurrence of the abnormal sound is prevented, too.

Figure 1:
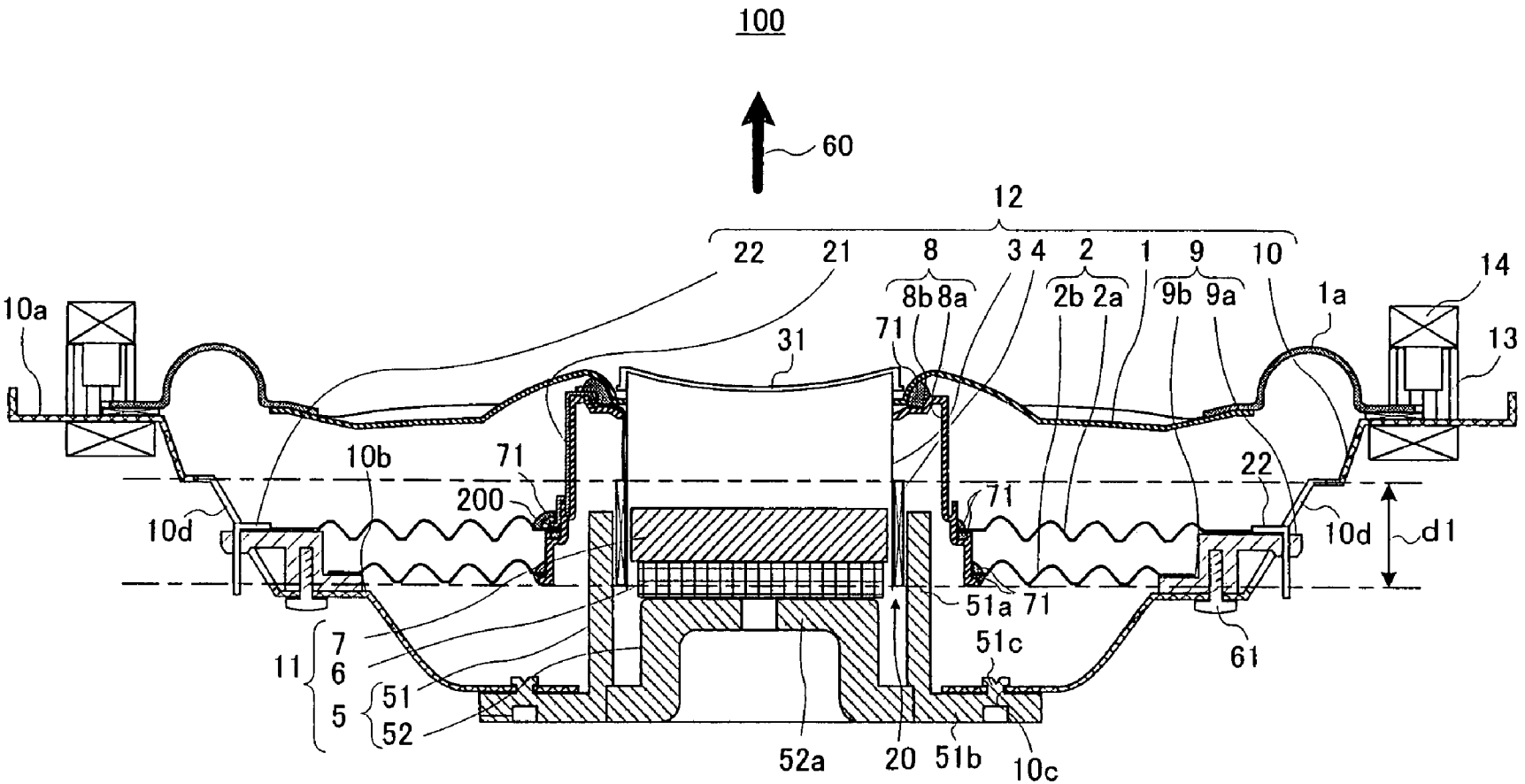
FIG. 1 is a sectional view of a speaker device according to an embodiment of the present invention.
Figure 2:
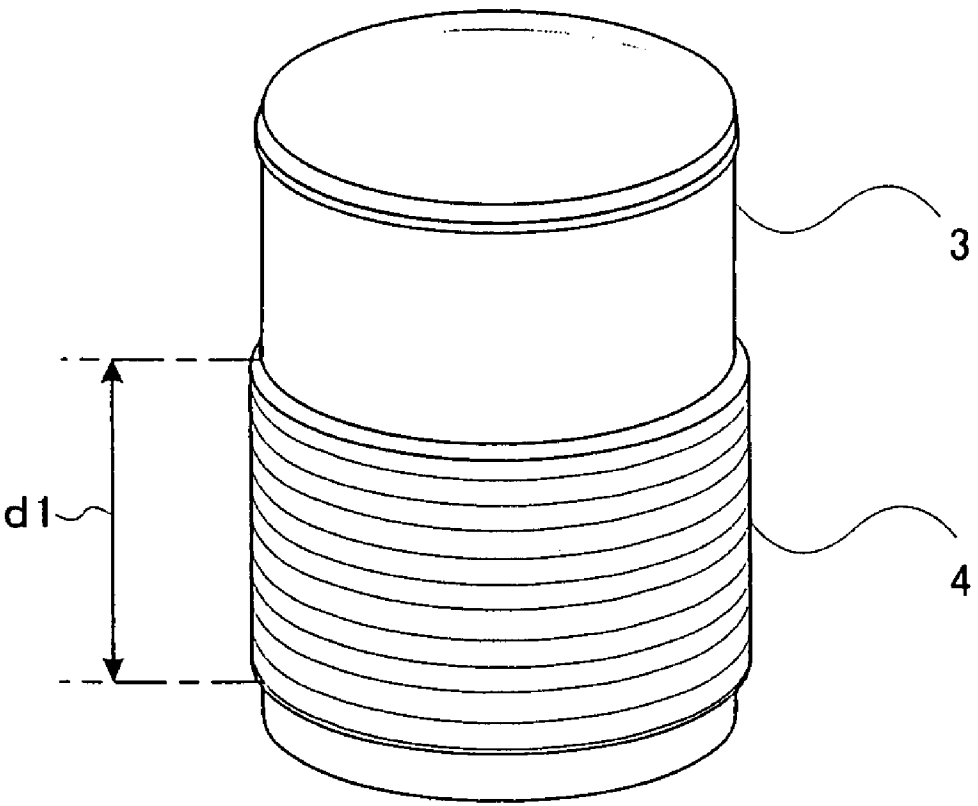
FIG. 2 shows a perspective view of a voice coil bobbin around which a voice coil is wound.

A general construction of a speaker device 100 according to the embodiment of the present invention will be schematically shown in FIG. 1. The speaker device 100 of this embodiment can be preferably used as an on-vehicle speaker. FIG. 1 shows a sectional view when cutting the speaker device 100 by a plane including a central axis thereof. FIG. 2 is a perspective view showing such a condition that the voice coil 4 is wound around the voice coil bobbin 3 in a constant winding width d1. A construction and the like of the speaker device 100 of this embodiment will be explained hereinafter with reference to FIG. 1 and FIG. 2.

As shown in FIG. 1, the speaker device 100 mainly includes a vibrating system 12 having a frame 10, a support member 9, a voice coil bobbin 3, a connecting member 8, a damper 2, terminal members 21, terminal members 22, a voice coil 4 and a diaphragm 1, a magnetic circuit system 11 having a pot type yoke 5, a magnet 6 and a plate 7, an anti-dust cap 31, and other various kinds of members.

First, each component of the vibrating system 12 will be explained.

Various components of the speaker device 100 are fixed to the frame 10, and the frame 10 has the function of supporting these components. The frame 10 is made of a metal material of good thermal conductivity. Therefore, the frame 10 has the function as a medium for giving and receiving heat to and from an external space of the speaker device 100 and its internal space. The frame 10 is formed into a pan-shape or pot-shape which is opened upward, and has a first flange part 10*a* formed at the top part for supporting an outer peripheral edge portion and the like of the diaphragm 1, a second flange part 10*b* formed at an intermediate part for supporting the support member 9, openings 10*c* formed in an inner peripheral edge portion, and a plurality of openings 10*d* formed at a side wall between the first flange part 10*a* and the second flange part 10*b*. A plurality of openings 10*c* are formed with fixed spaces therebetween in a circumferential direction of the inner peripheral edge portion. Each of the projecting portions 51*c* of the pot type yoke 5 before deformation, which will be described later, is inserted into each of the openings 10*c*.

The support member 9 is formed of, for example, a resin material, and is formed into a substantially annular shape in the plane view. The support member 9 is formed into a step shape in the sectional view, and has a top surface 9*a* and a top surface 9*b*. The support member 9 is mounted to the second flange part 10*b* by a fixing member 61 such as a male screw and a bolt.

The voice coil bobbin 3 is formed into a substantially cylindrical shape. The voice coil 4 is wound around an outer peripheral wall of a lower end portion of the voice coil bobbin 3 in the constant winding width d1 in the same direction as the central axial direction of the speaker device 100, as shown in FIG. 1 and FIG. 2. The inner peripheral wall of the lower end portion of the voice coil bobbin 3 is opposed to outer peripheral walls of the planar magnet 6 and plate 7 with a fixed space from them. The outer peripheral wall of the lower end portion of the voice coil bobbin 3 is opposed to an outer peripheral wall of an upper end portion of a pole piece 5 at a fixed space from it. A clearance (magnetic gap 20) is formed between an inner peripheral wall of the upper end portion of the pole piece 5 and an outer peripheral wall of the plate 7.

The connecting member 8 is formed of, for example, a resin material, has a cylindrical portion 8*a* formed into a substantially cylindrical shape and a bent portion 8*b* formed in a fashion being bent inwardly from an upper end of the cylindrical portion 8*a*, and is made by integrally forming them. An inner peripheral edge portion of the connecting member 8, namely, an inner peripheral edge portion of the bent portion 8*b* is fixed to an area in the vicinity of the upper end of the outer peripheral wall of the voice coil bobbin 3.

The damper 2 has a conductive damper 2*a* and an ordinary damper 2*b*. The conductive damper 2*a* is disposed above the damper 2*b*. The conductive damper 2*a* has a plurality of conductive members not shown. Each of the conductive members is sewn onto a top surface of the conductive damper 2*a* from the inner peripheral edge portion of the conductive damper 2*a* to its outer peripheral edge portion. The outer peripheral edge portion of the damper 2*b* is fixed to the top surface 9*b* of the support member 9 and the inner peripheral edge portion of the damper 2*b* is fixed to a lower end portion of the connecting member 8. Meanwhile, the outer peripheral edge portion of the conductive damper 2*a* is fixed to the top surface 9*a* of the support member 9 and the inner peripheral edge portion of the conductive damper 2*a* is fixed to an area in the vicinity of the lower end of the connecting member 8.

The terminal member 21 is a member such as metal having conductivity, and a plurality of terminal members 21 are provided. Each terminal member 21 is mounted to the connecting member 8. The upper end of each of the terminal members 21 is electrically connected to each lead wire of the voice coil 4, and a lower end of each of the terminal members 21 is electrically connected to each of the conductive members of the conductive damper 2*a*.

The terminal member 22 is a member having conductivity, and a plurality of terminal members 22 are provided. Each of the terminal members 22 is fixed to the top surface 9*a* of the support member 9. One end of each of the terminal members 22 is electrically connected to each of the conductive members of the conductive damper 2*a*, and the other end of each of the terminal members 22 is electrically connected to a relay wiring at an amplifier side not shown.

The voice coil 4 has a pair of positive/negative lead wires (not shown). A lead wire at the positive side is an input wiring for an L (or R) channel signal, and a lead wire at the negative side is an input wiring for a ground (GND: ground) signal. Each lead wire is electrically connected to the upper end of each of the terminal members 21 as described above. Therefore, an electric signal of one channel is inputted from the amplifier side into the voice coil 4 via each of the terminal members 22, each of the conductive members of the conductive damper 2*a*, each of the terminal members 21 and each of the lead wires.

The diaphragm 1 is formed into a substantially planer shape to be made thin. Various kinds of materials such as paper, polymer, and metal can be applied to the diaphragm 1 in accordance of the various kinds of use purposes. The edge portion 1*a* which is a separate piece from the diaphragm 1 is mounted to an outer peripheral edge portion of the diaphragm 1. The outer peripheral edge portion of the diaphragm 1 is fixed to the first flange part 10*a*. Meanwhile, an inner peripheral edge portion of the diaphragm 1 is fixed to the area in the vicinity of the upper end of the outer peripheral wall of the voice coil bobbin 3.

Next, each component of the magnetic circuit 11 will be explained.

The magnetic circuit system 11 is constructed as the internal magnet type magnetic circuit. This magnetic circuit has the pot type yoke 5, the planar magnet 6 and the planar plate 7. The pot type yoke 5 has a body part 51 and a bottom part 52, and they are bonded together. The pot type yoke 5 is mounted to the frame 10.

The body part 51 has a cylindrical portion 51*a*, a flange part 51*b*, and projecting portions 51*c* projecting upward from the top surface of the flange part 51*b*, and is formed by integrating them. The cylindrical portion 51*a* is formed into a substantially cylindrical shape. The cylindrical portion 51*a* extends upward from the area in the vicinity of the inner circumference of the flange part 51*b* to the position in the vicinity of the plate 7. The flange part 51*b* extends in the outward direction substantially perpendicularly from the position in the vicinity of the lower end of the outer peripheral wall of the cylindrical portion 51*a*. The inner peripheral edge portion of the frame 10 is mounted to the top surface of the flange part 51*b*. The projecting portion 51*c* is formed into the columnar shape and a plurality of projecting portions 51*c* are formed on the top surface of the flange part 51*b* with fixed spaces from each other. Each of the projecting portions 51*c* has the function of fixing the inner peripheral edge portion of the frame 10 by being caulked.

The bottom part 52 has the sectional shape of substantially inversed recessed shape. The bottom part 52 has a mounting portion 52*a* which has substantially the same size as the diameters of the planer magnet 6 and the planar plate 7. The outer peripheral edge portion of the bottom part 52 is connected to the body part 51.

The planar magnet 6 is fixed onto the bottom part 52 of the pot type yoke 5 which will be described later. The planar plate 7 is fixed onto the magnet 6. In the magnetic circuit system 11, the magnetic circuit is constructed by the magnet 6 and the plate 7, and magnetic flux of the magnet 6 is concentrated at the magnetic gap 20 formed between the outer peripheral wall of the plate 7 and the inner peripheral wall of the pot type yoke 5.

The anti-dust cap 31 is mounted to the upper end portion of the voice coil bobbin 3 via the adhesive so as to close the top surface of the voice coil bobbin 3. Thereby, the anti-dust cap 31 has the function of preventing a foreign matter or the like from entering the inside of the speaker device 100.

Next, various kinds of component members will be explained.

Various kinds of component members include a packing 13, a buffer member 14 and the like.

The packing 13 is formed into an annular shape and is the member having insulating property. As the material for the packing 13, for example, a resin material is preferable. The bottom surface of the packing 13 is fixed to the first flange part 10*a* and the outer peripheral edge part of the edge portion 1*a*. Thereby, the outer peripheral edge part of the diaphragm 1 and the edge portion 1*a* is sandwiched by the packing 13 and the first flange part 10*a*.

The buffer member 14 has the function as the buffer material when the speaker device 100 is mounted to a predetermined position of the vehicle, for example, and has the function and the like of preventing the vibration from the outside from being transmitted to the body of the speaker device 100. Therefore, as the material of the buffer member 14, for example, a member having cushioning property such as sponge is preferable. The buffer member 14 has a rod shape before being mounted, and an adhesive is applied to one side surface, or a double-side adhesive tape is attached to one side surface. The buffer member 14 is attached on the upper surface of the packing 13 via the adhesive or the double-side adhesive tape in the state in which it is deformed in an annular shape.

In the speaker device 100 which is described above, an electric signal outputted from the amplifier is supplied to the voice coil 4 via each of the terminal members 22, each of the conductive members of the conductive damper 2*a*, each of the terminal members 21 and each lead wire of the voice coil 4. Thereby, driving force occurs to the voice coil 4 in the magnetic gap 20, and vibrates the diaphragm 1 in the axial direction of the speaker device 100. Thus, the speaker device 100 emits acoustic waves in the direction of the arrow 60.

[Structure of Supporting Damper]

Next, the description will be given of a structure of supporting the damper 2 characterized by the present invention, with reference to FIG. 1 to FIG. 5.

As described above, each inner peripheral edge portion of the conductive damper 2*a* and the damper 2*b* is fixed to the area in the vicinity of the lower end of the cylindrical portion 8*a* of the connecting member 8, and each outer peripheral edge portion of the conductive damper 2*a* and the damper 2*b* is fixed to the support member 9. Therefore, as shown in FIG. 1, the conductive damper 2*a* and the damper 2*b* are arranged within the constant winding width d1 of the voice coil 4 in the non-driving state of the speaker device. Particularly, since one portion of the damper 2 of the present embodiment, i.e., the inner peripheral edge portion, is arranged within the constant winding width d1 of the voice coil 4 via the connecting member 8, it has a characteristic effect.

Figure 3B:
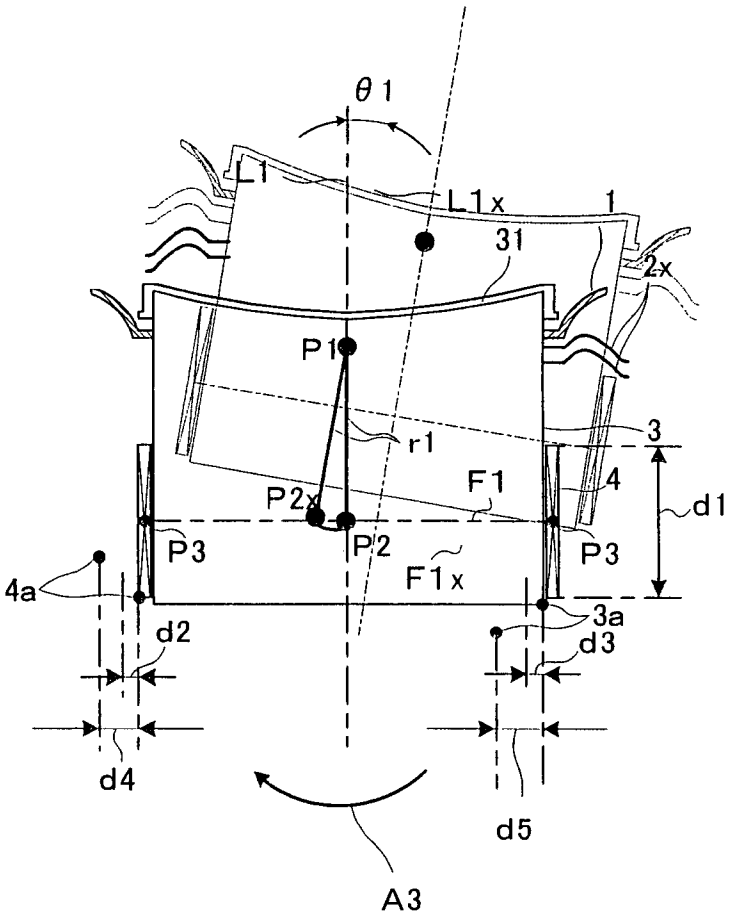
FIG. 3(b) PRIOR ART
FIGS. 3A and 3B show a structure of supporting an ordinary damper.
Figure 3A:
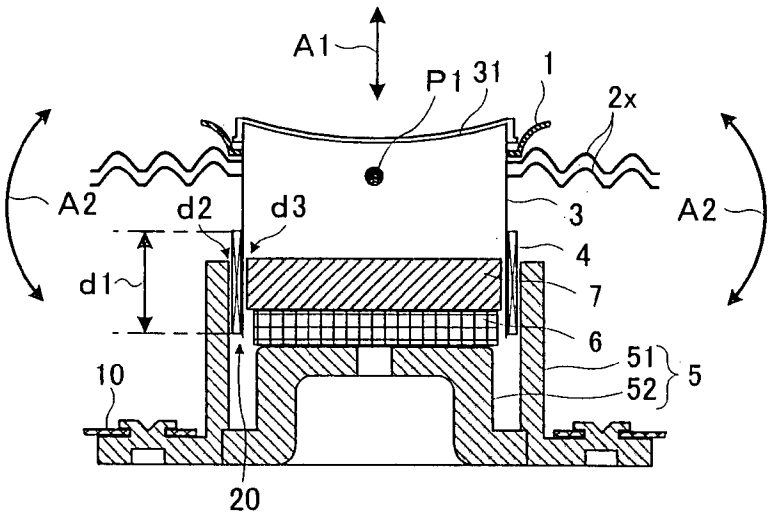
FIG. 3(a) PRIOR ART
Figure 4:
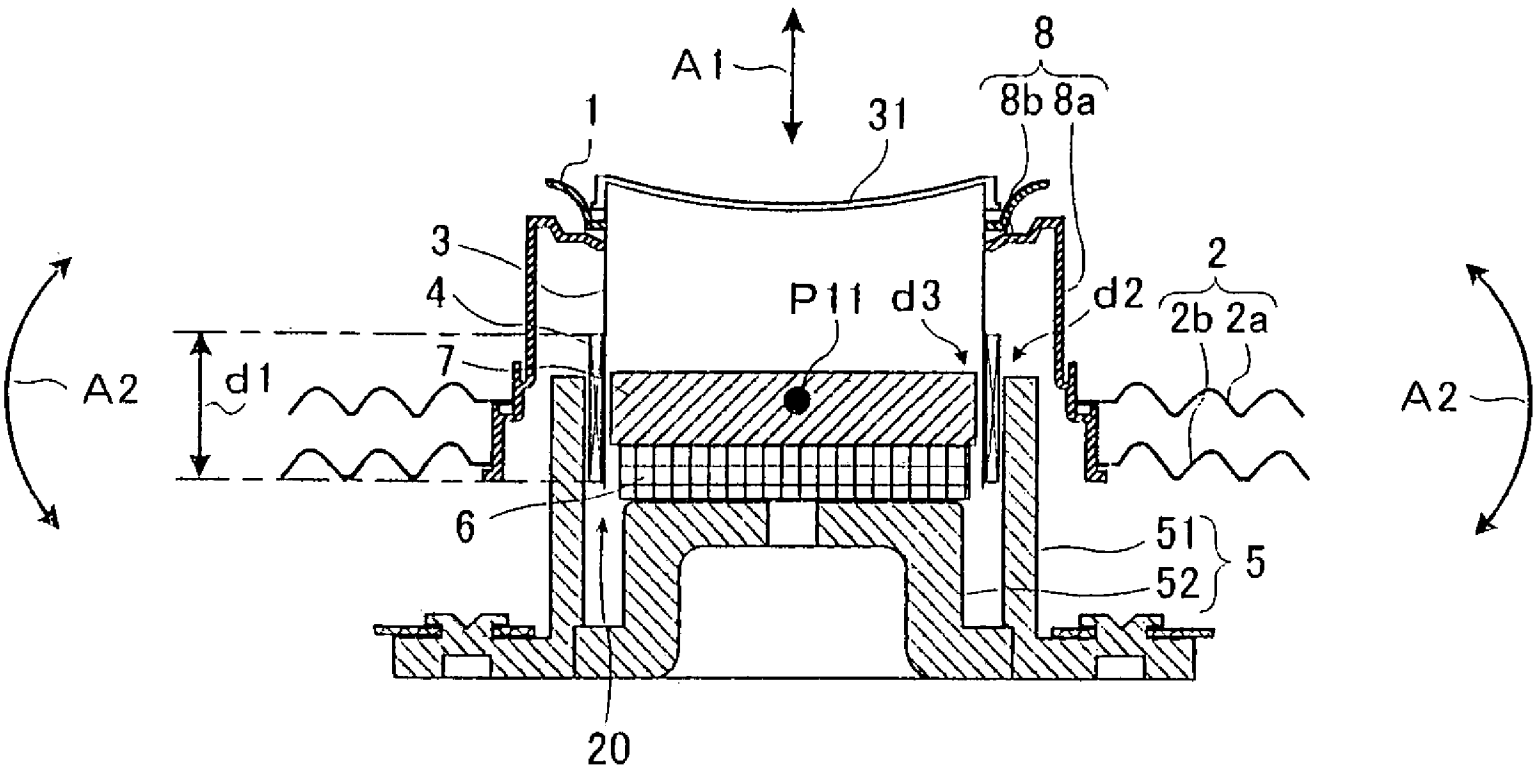
FIG. 4 shows a structure of supporting a damper according to this embodiment.
Figure 5:
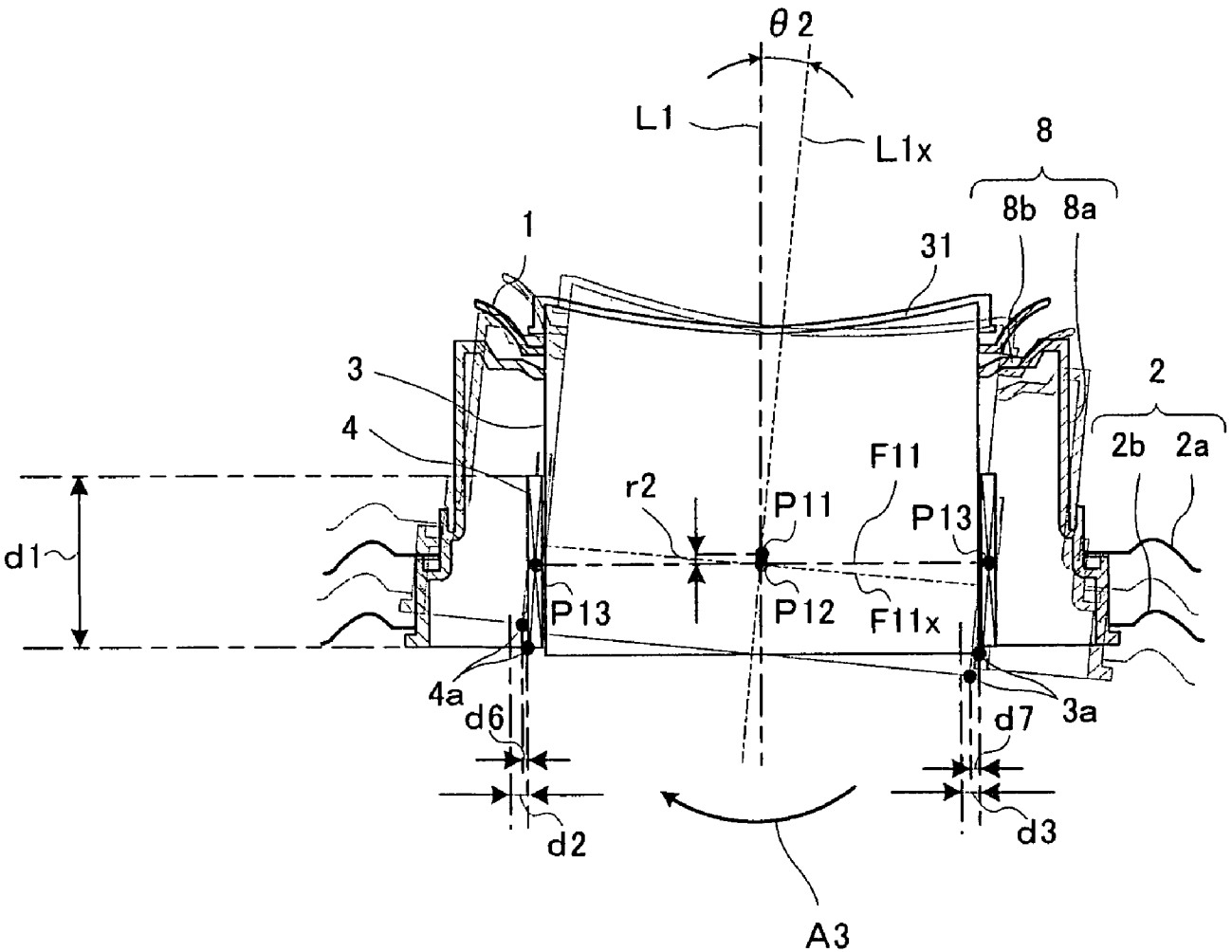
FIG. 5 shows the structure of supporting the damper according to this embodiment.

The characteristic effect will be explained in detail below. For convenience of the explanation, the description will be given below by comparing the operation and effect of the structure of supporting the ordinary damper and the operation and effect of the structure of supporting the damper 2 according to the present embodiment. FIGS. 3A and 3B show the structure of supporting the ordinary damper 2*x* and a state in a case that the voice coil bobbin 3 supported by the ordinary damper 2*x* rolls at the time of the vibration of the vibrating system 12 including the voice coil bobbin 3. In FIGS. 3A and 3B, the same reference numerals are given to components same as the components shown in FIG. 1, and the explanation of them is omitted. On the contrary, FIG. 4 and FIG. 5 show the structure of supporting the damper 2 according to the present embodiment and a state in a case that the voice coil bobbin 3 supported by the damper 2 rolls at the time of the magnitude of the vibrating system 12 including the voice coil bobbin 3.

First, the description will be given of points common and different between the structure of supporting the ordinary damper 2*x* and the structure of supporting the damper 2 according to the present embodiment, with reference to FIG. 3A and FIG. 4.

The common point of them is below. Namely, the ordinary damper 2*x* includes plural dampers, similarly to the damper 2 according to the present embodiment. Each of the dampers is made of the material similar to the damper 2 of the present embodiment respectively.

In both of the structures, a constant gap d2 is formed between the outer peripheral wall of the voice coil 4 and the body part 51 of the pot type yoke 5, and a constant gap d3 is formed between the inner peripheral wall of the voice coil bobbin 4 and the outer peripheral wall of the plate 7. Also, in both of the structures, the magnitude of the driving signal applied to the voice coil 4 is same. Further, in both of the structures, the voice coil 4 is wound around the lower end portion of the outer peripheral wall of the voice coil bobbin 3 in the constant winding width d1.

The different point between them is below. Namely, the inner peripheral edge portion of the ordinary damper 2*x* is fixed to the upper end portion of the outer peripheral wall of the voice coil bobbin 3. On the contrary, as described above, the inner peripheral edge portion of the damper 2 of the present embodiment is fixed to the portion in the vicinity of the lower end of the connecting member 8, i.e., the area in the vicinity of the lower end of the outer peripheral wall of the cylindrical portion 8*a*. At the time of driving the speaker device, the magnitude of the rolling of the voice coil bobbin 3 is different between them due to such the structural difference. This point will be explained below.

First, the description will be given of the positional relation and the like between the ordinary damper 2*x* and the voice coil bobbin 3 in a case that the rolling occurs, with reference to FIGS. 3A and 3B. When the speaker device is driven, as shown in FIG. 3A, the voice coil bobbin 3, which is supported by the inner peripheral edge portion of the damper 2*x*, vibrates in the direction of an arrow A1. At this time, the balance of the vibrating system including the voice coil bobbin 3 is sometimes lost due to various factors, and the voice coil bobbin 3 rolls in the direction of arrows A2 with a fulcrum P1 as its center. It can be thought that the fulcrum P1 corresponds to the center position of the voice coil bobbin on the horizontal surface including the damper in FIG. 3A.

FIG. 3B shows a state in a case that the voice coil bobbin 3 rolls on the left side of the drawing, i.e., in the direction of an arrow A3. For convenience of the explanation, only the ordinary damper 2*x*, the voice coil bobbin 3 and the voice coil 4 are shown in FIG. 3B. In FIG. 3B, a portion shown by a solid line shows the positions of the voice coil bobbin 3 and the like in a case that the voice coil bobbin 3 is not rolling. On the contrary, a portion shown by a broken line shows the positions of the voice coil bobbin 3 and the like in the case that the voice coil bobbin 3 is rolling in the direction of the arrow A3. A straight line L1 shown by a chain line is the central axis of the voice coil bobbin 3, i.e., the central axis of the speaker device. As described above, the point P1 is the center position of the voice coil bobbin on the horizontal surface including the damper, and the point P1 is on the central axis of the speaker device. A point P2 is an intersection of the straight line L1 and the horizontal section F1 of the voice coil 4, which corresponds to a center point P3 in the direction of the winding width of the voice coil 4. A distance between the points P1 and P2 is r1.

By the rolling of the voice coil bobbin 3 in the direction of the arrow A3 with the fulcrum P1 as its center, the voice coil bobbin 3 and the like move to the position shown by the broken line at the maximum. Therefore, the straight line L1 rotates clockwise by an angle θ1 to move to the position of a straight line L1*x*. The plane surface F1 rotates clockwise by a predetermined angle to move to the position of a plane surface F1*x*. At the same time, the point P2 moves on an arc of the radius r1 with the point P1 as its center to move to the position of a point P2*x*. Thus, the lower end portion 4*a* of the outer peripheral wall of the voice coil 4, which is located on the left side of the drawing, moves to the position shown by the broken line.

Thereby, the distance between the lower end portion 4*a* of the voice coil 4 at the time of the non-rolling, which is shown by the solid line, and the lower end portion 4*a* of the voice coil 4 at the time of the rolling, which is shown by the broken line, becomes d4 (>d2) at the maximum. Therefore, as understood with reference to FIGS. 3A and 3B, the area in the vicinity of the lower end portion 4*a* of the outer peripheral wall of the voice coil 4 contacts the body part 51 of the pot type yoke 5. The lower end portion 3*a* of the inner peripheral wall of the voice coil bobbin 3 located on the right side of the drawing moves to the position shown by the broken line. Thereby, the distance between the lower end portion 3*a* of the voice coil bobbin 3 at the time of the non-rolling, which is shown by the solid line, and the lower end portion 3*a* of the voice coil bobbin 3 at the time of the rolling, which is shown by the broken line, becomes d5 (>d3) at the maximum. As understood with reference to FIGS. 3A and 3B, the area in the vicinity of the lower end portion 3*a* of the inner peripheral wall of the voice coil bobbin 3 contacts the plate 7.

As described above, according to the structure of supporting the ordinary damper 2*x*, the fulcrum P1 at the time of the rolling is located at the position above the voice coil 4. Therefore, the distance r1 from the fulcrum P1 to the intersection P2 of the plane surface F1 including the center point P3 in the direction of the winding width of the voice coil 4 and the central axis L1 of the speaker device becomes long, and the voice coil bobbin 3 widely rolls. Thus, the voice coil 4 contacts the pot type yoke 5, or the voice coil bobbin 3 contacts the plate 7, which causes the abnormal sound.

Though the condition in the case that the voice coil bobbin 3 is rolling on the left side of the drawing is explained as an example in FIG. 3B, a condition in a case that the voice coil bobbin 3 is rolling on the right side of the drawing is similar, too.

Next, the description will be given of the positional relation between the damper 2 of the present embodiment and the voice coil bobbin 3 at the time of the occurrence of the rolling, with reference to FIG. 4 and FIG. 5. When the speaker device 100 is driven, as shown in FIG. 4, the voice coil bobbin 3, which is supported by the damper 2 via the connecting member 8, vibrates in the direction of the arrow A1. At this time, the balance of the vibrating system including the voice coil bobbin 3 is sometimes lost due to various factors, and the voice coil bobbin 3 rolls in the direction of the arrows A2 with a fulcrum P11 as its center. In FIG. 4, the fulcrum P11 corresponds to the center position of the voice coil bobbin 3 on the horizontal surface including the conductive damper 2*a*.

FIG. 5 shows the condition in the case that the voice coil bobbin 3 rolls on the left side, i.e., in the direction of the arrow A3. For convenience of the explanation, only the damper 2, the voice coil bobbin 3 and the voice coil 4 are shown in FIG. 5. In FIG. 5, a portion shown by the solid line shows the position of the voice coil bobbin 3 in the case that the voice coil bobbin 3 is not rolling. On the contrary, a portion shown by the broken line shows the position of the voice coil bobbin 3 in the case that the voice coil bobbin 3 is rolling in the direction of the arrow A3. The straight line L1 shown by the chain line is the central axis of the voice coil bobbin 3, i.e., the central axis of the speaker device. As described above, the point P11 is the central position of the voice coil bobbin on the horizontal surface including the conductive damper 2*a*, and is located on the central axis of the speaker device 100. A point P12 is an intersection of the straight line L1 and a horizontal section F11 of the voice coil 4, which corresponds to the center point P13 in the direction of the winding width d1 of the voice coil 4. A distance between the point P11 and the point P12 is r2 (<r1).

By the rolling of the voice coil bobbin 3 in the direction of the arrow A3 with the fulcrum P11 as its center, the voice coil bobbin 3 moves to the position shown by the broken line at the maximum. Therefore, the straight line L1 rotates clockwise by an angle θ2 to move to the position of the straight line L1*x*. The plane surface F11 rotates clockwise by a predetermined angle to move to the position of a plane surface F11*x*, and the point P12 slightly moves. The position of the moved point P12, which is almost same as the original position of the point P12, is omitted in FIG. 5. The lower end portion 4*a* of the outer peripheral wall of the voice coil 4 located on the left side of the drawing moves to the position shown by the broken line.

Thereby, the distance between the lower end portion 4*a* of the voice coil 4 at the time of the non-rolling, which is shown by the solid line, and the lower end portion 4*a* of the voice coil 4 at the time of the rolling, which is shown by the broken line, becomes d6 (<d2) at the maximum. As understood with reference to FIG. 4 and FIG. 5, the area in the vicinity of the lower end portion 4*a* of the outer peripheral wall of the voice coil 4 never contacts the body part 51 of the pot type yoke 5. The lower end portion 3*a* of the inner peripheral wall of the voice coil bobbin 3 located on the right side of the drawing moves to the position shown by the broken line. Thereby, the distance between the lower end portion 3*a* of the voice coil bobbin 3 at the time of the non-rolling, shown by the solid line, and the lower end portion 3*a* of the voice coil bobbin 3 at the time of the rolling, shown by the broken line, becomes d7 (<d3) at the maximum. As understood with reference to FIG. 4 and FIG. 5, the area in the vicinity of the lower end portion 3*a* of the inner peripheral wall of the voice coil bobbin 3 never contacts the plate 7.

As described above, by comparing the structure of supporting the ordinary damper 2*x* and the structure of supporting the damper 2 of the present embodiment, there is understood below. As shown in FIGS. 3A and 3B, in the structure of supporting the ordinary damper 2*x*, the fulcrum P1 at the time of the rolling is at the position above the voice coil 4. On the contrary, as shown in FIG. 4, in the structure of supporting the damper 2 of the present embodiment, the fulcrum P11 at the time of the rolling is within the winding width d1 of the voice coil 4.

Therefore, in the structure of supporting the ordinary damper 2*x*, as described above, the voice coil bobbin 3 widely rolls. However, in the structure of supporting the damper 2 of the present embodiment, the distance r2 from the fulcrum P11 to the portion around which the voice coil 4 of the voice coil bobbin 3 is wound, more concretely, the distance r2 from the fulcrum P11 to the intersection P12 of the central axis L1 of the speaker device 100 and the plane surface F11 including the center point P13 in the direction of the winding width d1 of the voice coil 4, becomes short. Therefore, even when the voice coil bobbin 3 rolls, the moving amount thereof becomes small. According to the structure of supporting the damper 2 of the present embodiment, at the time of the rolling, it becomes possible to prevent not only the contact between the voice coil 4 and the pot type yoke 5 but also the contact between the voice coil bobbin 3 and the plate 7. Therefore, the occurrence of the abnormal sound can be prevented.

In FIG. 5, the description is given of the condition in the case that the voice coil bobbin 3 is rolling on the left side of the drawing, as an example. However, the condition in a case that the voice coil bobbin 3 is rolling on the right side of the drawing is similar.

[Modification]

In the above embodiment, the respective inner peripheral edge portions of the plural dampers (i.e., the conductive damper 2*a* and the damper 2*b*) are arranged within the winding width of the voice coil 4, and they are fixed to the area in the vicinity of the lower end of the connecting member 8. However, the application of the present invention is not limited to it. Only the conductive damper 2*a* or only the damper 2*b* may be provided, and the inner peripheral edge portion of it may be arranged within the winding width of the voice coil 4 to be fixed to the area in the vicinity of the lower end of the connecting member 8. In the case, the effect similar to the above-mentioned embodiment can be obtained.

What is claimed is:

1. A speaker device, comprising:

a vibrating system, comprising two dampers, a voice coil bobbin, a voice coil wound around an outer circumference of the voice coil bobbin with a constant winding width, and a connecting member attached to the voice coil bobbin at a position above the voice coil;

a frame configured to support the vibrating system; and a magnetic gap, wherein an upper end of the voice coil is located above an upper end of the magnetic gap, wherein a lower end of the voice coil is located below a lower end of the magnetic gap, wherein a width of the difference between the upper end of the voice coil and the upper end of the magnetic gap is equal or nearly equal to a width of the difference between the lower end of the voice coil and the lower end of the magnetic gap, wherein inner peripheral edge portions of the two dampers are attached to the connecting member at a position between the upper end of the voice coil and the lower end of the voice coil, and wherein outer peripheral edge portions of the two dampers are supported by the frame at a position between the upper end of the voice coil and the lower end of the voice coil.

2. The speaker device according to claim 1, wherein the outer peripheral edge portions of the two dampers are attached to a support member attached to the frame.

3. A speaker device, comprising:

a vibrating system, comprising two dampers, a voice coil bobbin, a voice coil wound around an outer circumference of the voice coil bobbin, and a connecting member attached to the voice coil bobbin at a position above the voice coil;

a magnetic circuit system, comprising a bottom part, a magnet connected to the bottom part, a plate connected to the magnet opposite the bottom part, and a body part surrounding the magnet and the plate; and a frame configured to support the vibrating system and the magnetic circuit system, wherein a winding width of the voice coil extending along a longitudinal length of the voice coil bobbin is constant along an entire circumference of the voice coil, wherein a magnetic gap is formed between an outer peripheral wall of the plate and an inner peripheral wall of an upper end portion of the body part, wherein an uppermost end of the voice coil is located above an uppermost end of the magnetic gap, wherein a lowermost end of the voice coil is located below a lowermost end of the magnetic gap, wherein a distance between the uppermost end of the voice coil and the uppermost end of the magnetic gap is equal or nearly equal to a distance between the lowermost end of the voice coil and the lowermost end of the magnetic gap, wherein inner peripheral edge portions of the two dampers are attached to the connecting member at a position between the uppermost end of the voice coil and the lowermost end of the voice coil, and wherein outer peripheral edge portions of the two dampers are supported by the frame at a position between the uppermost end of the voice coil and the lowermost end of the voice coil.

4. The speaker device according to claim 3, wherein the frame further comprises a support member attached to the frame, and wherein the outer peripheral edge portions of the two dampers are attached to the support member.

* * * * *

UNITED STATES PATENT AND TRADEMARK OFFICE

CERTIFICATE OF CORRECTION

PATENT NO. : 7,587,060 B2
APPLICATION NO. : 11/084117
DATED : September 8, 2009
INVENTOR(S) : Tomoyuki Watanabe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1198 days.

Signed and Sealed this

Fourteenth Day of December, 2010

David J. Kappos

David J. Kappos
*Director of the United States Patent and Trademark Office*